United States Patent [19]

Wilkes

[11] Patent Number: 5,037,145

[45] Date of Patent: Aug. 6, 1991

[54] VEHICLE DOOR LOCK ACTUATOR

[75] Inventor: Steven F. Wilkes, West Midlands, United Kingdom

[73] Assignee: Rockwell Automotive Body Components (UK) Ltd., United Kingdom

[21] Appl. No.: 337,954

[22] Filed: Apr. 14, 1989

[30] Foreign Application Priority Data

Apr. 12, 1989 [GB] United Kingdom ..... 8809023

[51] Int. Cl.[5] ..... E05B 3/26

[52] U.S. Cl. ..... 292/201; 292/336.3; 292/DIG. 62; 74/89.15

[58] Field of Search ..... 74/89.15; 292/201, 336.3, 292/216, 280, 347, DIG. 62; 70/264

[56] References Cited

U.S. PATENT DOCUMENTS 4,342,209 8/1982 Kleefeldt ..... 70/237 X
4,723,454 2/1988 Periou et al. ..... 292/201

FOREIGN PATENT DOCUMENTS 2176528A 12/1986 United Kingdom .
2207698A 2/1989 United Kingdom .

*Primary Examiner*—Richard E. Moore
*Attorney, Agent, or Firm*—Learman & McCulloch

[57] ABSTRACT

Motorized actuator for vehicle door locks e.g. as part of a central locking system has a powered drive input element (20), a drive output element (24) movement of which locks and unlocks the lock, and a clutch element (34) operating to transmit drive to the output element but having a disengaged condition permitting independent (e.g. manual) actuation of the lock. A camming formation (28) of the input element has a formation (34) of the clutch element coacting therewith and the clutch element has another camming formation (36) engaging another coacting formation (38) of the output element. The formations are provided with acting faces (32,44,46) angles so that drive force applied from the input element through the clutch element to move the output element against reaction loading of the latter acts to urge the clutch and output elements into positive drive transmitting engagement but reaction foces translated from the output element with no drive force from the input element releases the clutch engagement by camming the latter formations out of drive transmitting engagement automatically to put the mechanism into the disengaged condition. Preferably powered movement of the input element with the mechanism in the latter condition further shifts the clutch element into a superlocked condition in which the output element is positively retained in that condition.

18 Claims, 5 Drawing Sheets

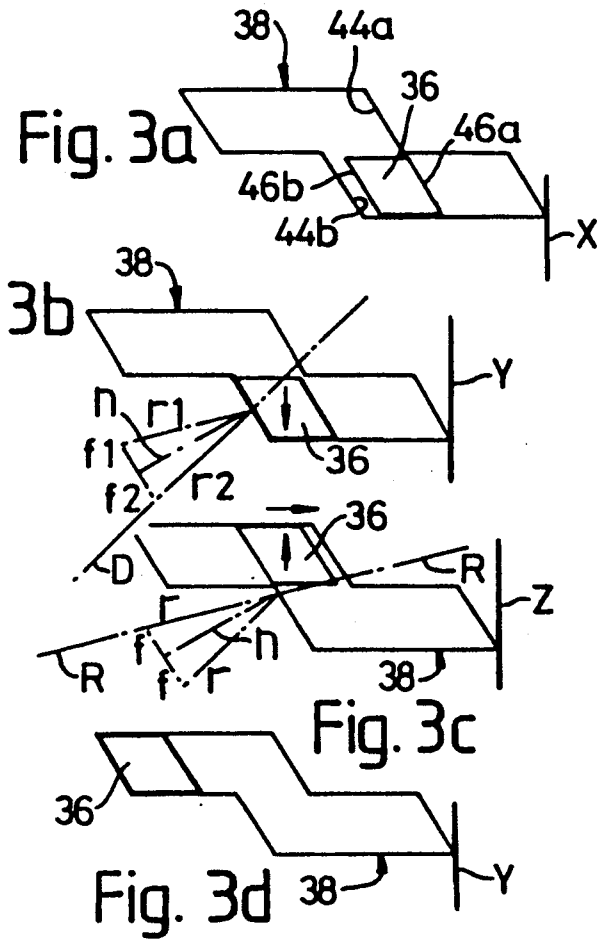
Fig. 3a
Fig. 3b
Fig. 3c
Fig. 3d
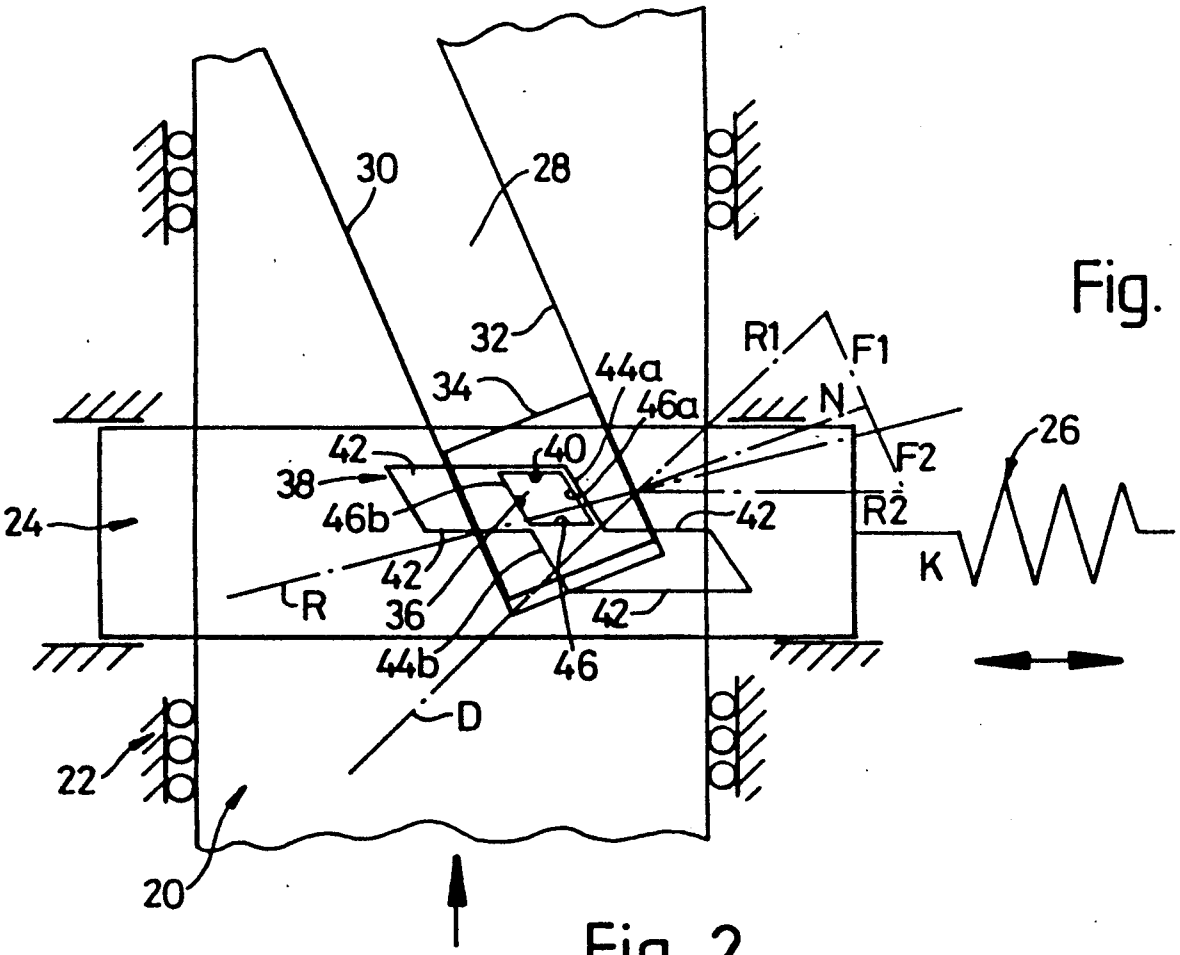
Fig. 2

VEHICLE DOOR LOCK ACTUATOR

This invention relates to power operated actuators for vehicle door locks and central locking systems including said actuators.

Vehicles such as passenger cars are commonly equipped with individual latches securing the driver's and passenger doors and other covers or doors such as the rear doors of estate or "hatchback" vehicles, luggage boot or trunk lids, the bonnet, fuel filler cap covers and the like, and, the rising incidence of theft, vandalism and other vehicle associated crime makes it ever more desirable that effective locking of all such latches be provided. In most cases each latch will have an individual mechanical lock typically key operated from the exterior of the vehicle and, in the case of the driver's and passenger doors, also having means for mechanical locking from within the vehicle, e.g. a respective sill button. It is also increasingly common to provide electrical servo-actuators linked to or built into each latch and connected in circuit with a central locking system controlled from one or more selected points, e.g. by operation of the key lock of the driver's door so that all the latches can be locked or unlocked simultaneously.

Typically, in known systems, the servo-actuator operates only momentarily, i.e. to effect shifting of the lock mechanism between locked and unlocked conditions to secure or free the associated latch. When operation ceases the lock will remain in that condition but is not retained by the actuator mechanism, the respective key or sill button etc can be used to unlock the associated latch. This form of central operation adds to the convenience of operation but does not, in itself, enhance the security of the locked vehicle. If the locking linkage or mechanism can be accessed from outside, e.g. through a window by "fishing" to engage the sill button from outside, or by inserting a hook or other tool into the interior of the door to engage and pull a connecting link it may be relatively easy to shift the lock mechanism and free the latch.

To improve security it is desirable that a super locking mode is provided, conveniently actuable through a central locking system, in which all the latches are deadlocked by being positively held in the locked condition i.e. the locks cannot be released by any interference with the mechanism normally likely or by manual operation of such elements as the internal sill button. Various mechanisms and systems have been proposed for this purpose, for example those described in our co-pending patent applications GB 2176528A and GB 8718710 of 7th Aug. 1987; and in U.S. Pat. No. 4342209.

The object of the present invention is to provide an actuator mechanism which is particularly effective in operation, which has few moving parts and is thus economical to produce which can be provided in a number of compact space-saving forms to be combined with the latch mechanism or as a compact separate unit readily connected to the latch e.g. in the limited space within a vehicle door, which can be reliably operated by simple electrical circuitry and switching, which does not affect the ease of manual operation of the latch and locking mechanism, and which can particularly readily provide facility for a simple yet high security centralised super locking mode.

According to the invention there is provided vehicle door latch lock power actuating mechanism including an operatively power driven drive input element, a drive output element connected for positive actuation of the lock between locked and unlocked conditions, and a clutch element operating to engage and transmit drive from the input to the output element but having a disengaged condition permitting actuation of the lock independently of said drive; characterised in that one of the input element and clutch element includes a first force transmitting camming formation with which a formation of the other of said elements coacts, and one of the clutch element and output element includes a second force transmitting camming formation with which a formation of the other of said latter elements coacts, said camming formations being so angled and disposed that drive force translated from the input element for movement of the output element against reaction loading on the latter element includes a component urging said formations into continued drive transmitting engagement but reaction forces translated from the output element with no drive force from the input element will cam coacting said formations out of drive transmitting engagement with each other to put the mechanism into said disengaged condition.

One or both of said camming formations may include a rectilinear acting face angled with respect to the direction of rectilinear or other movement of the element acting thereon, or a helical acting face at a pitch angle with respect to the direction of rotation or other movement of the element acting thereon. Said acting face angle of the first or second formation is preferably substantially different from said angle of the other of said formations.

Preferably the first camming formation has a said angle which is lower than that of the second camming formation whereby it is the latter which is so cammed out of driving engagement with its coacting formation to disengage drive between the clutch element and the output element.

It is also preferred that said reaction disengagement following from powered shifting of the lock to locked condition leaves the elements positioned so that a further powered movement of the input member in the locking direction effects superlocking by engaging the respective camming formation with a non-camming formation of the coacting element for positive location of the output element in the locked condition.

Some examples of the invention are now more particularly described with reference to the accompanying drawings wherein:

FIG. 2 is a diagrammatic representation of a first embodiment of the invention being a simple form of servo-actuator;

Figure 4A:
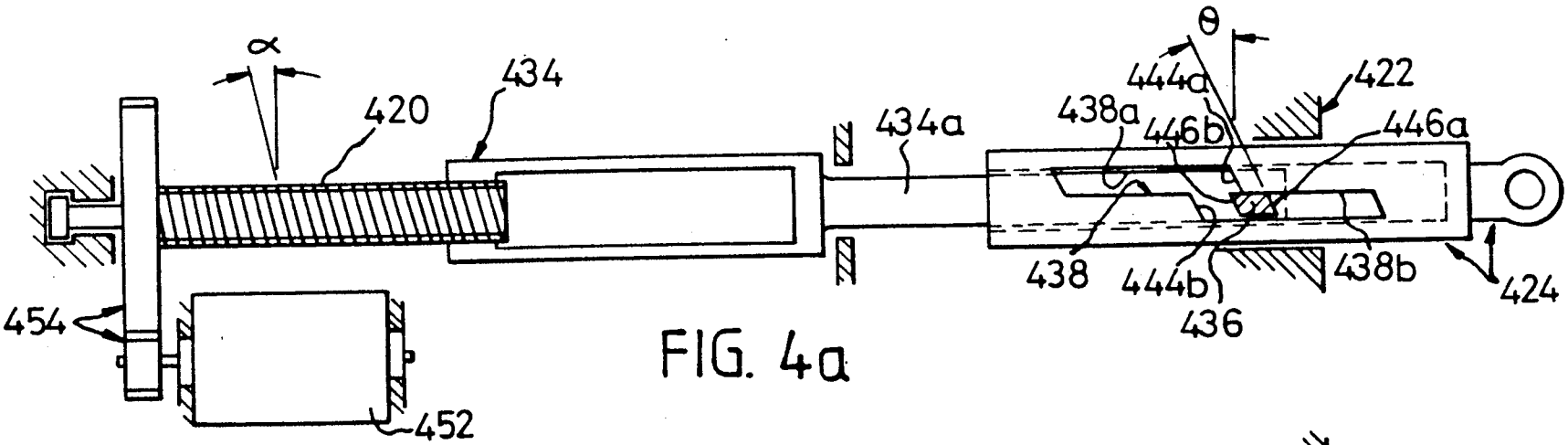
Figure 4B:
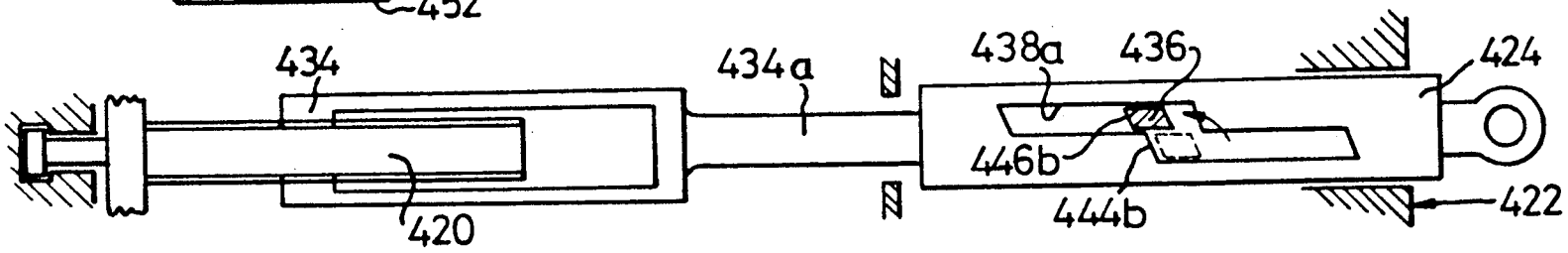
Figure 4C:
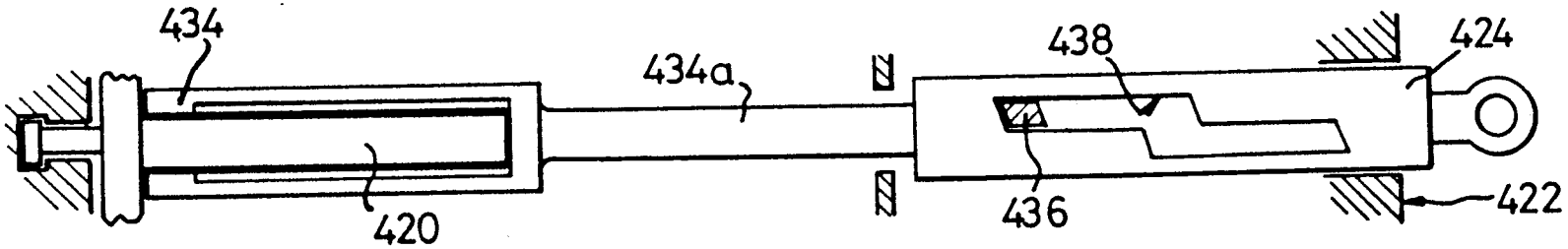
Figure 5:
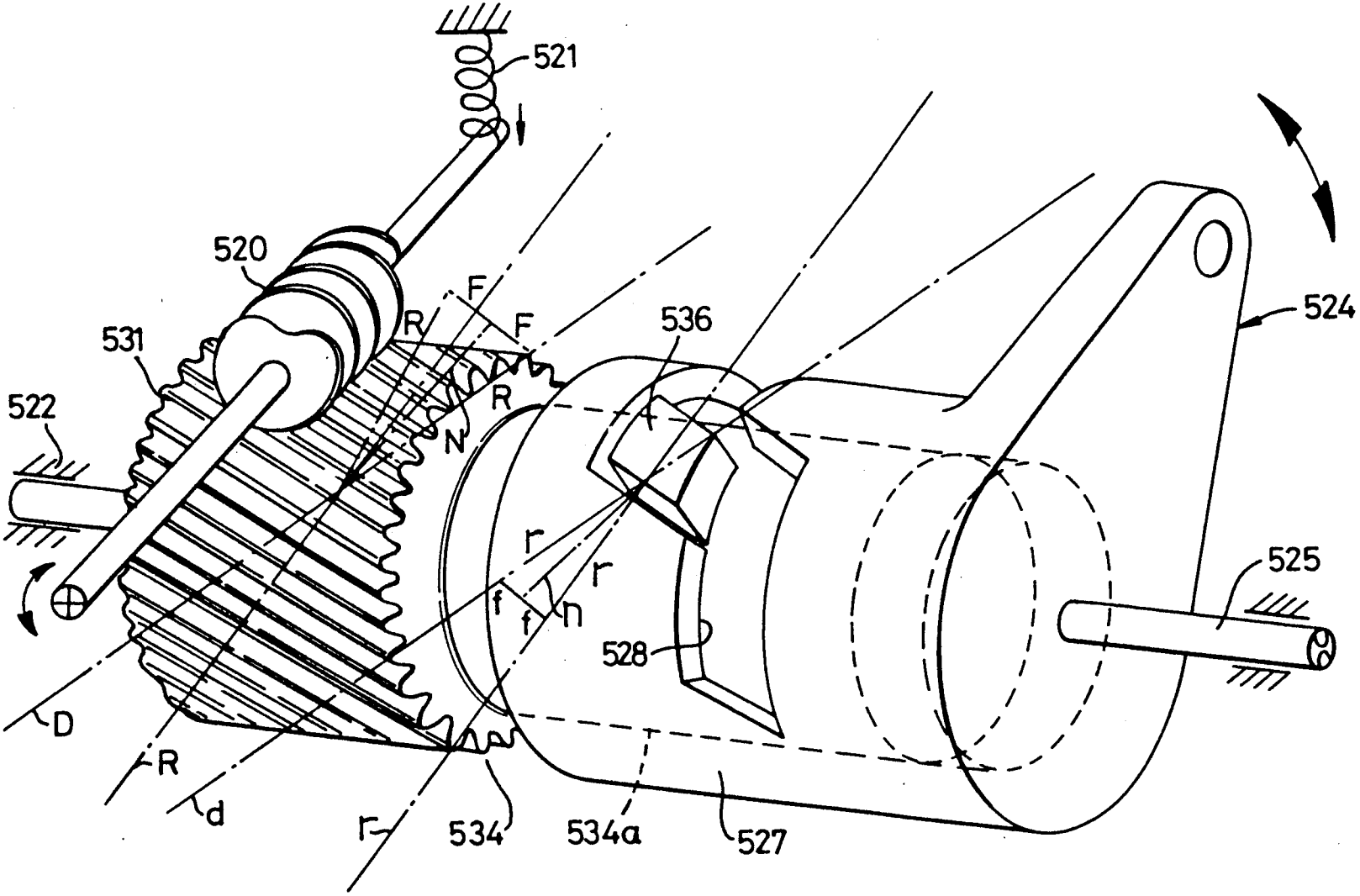
Figure 6:
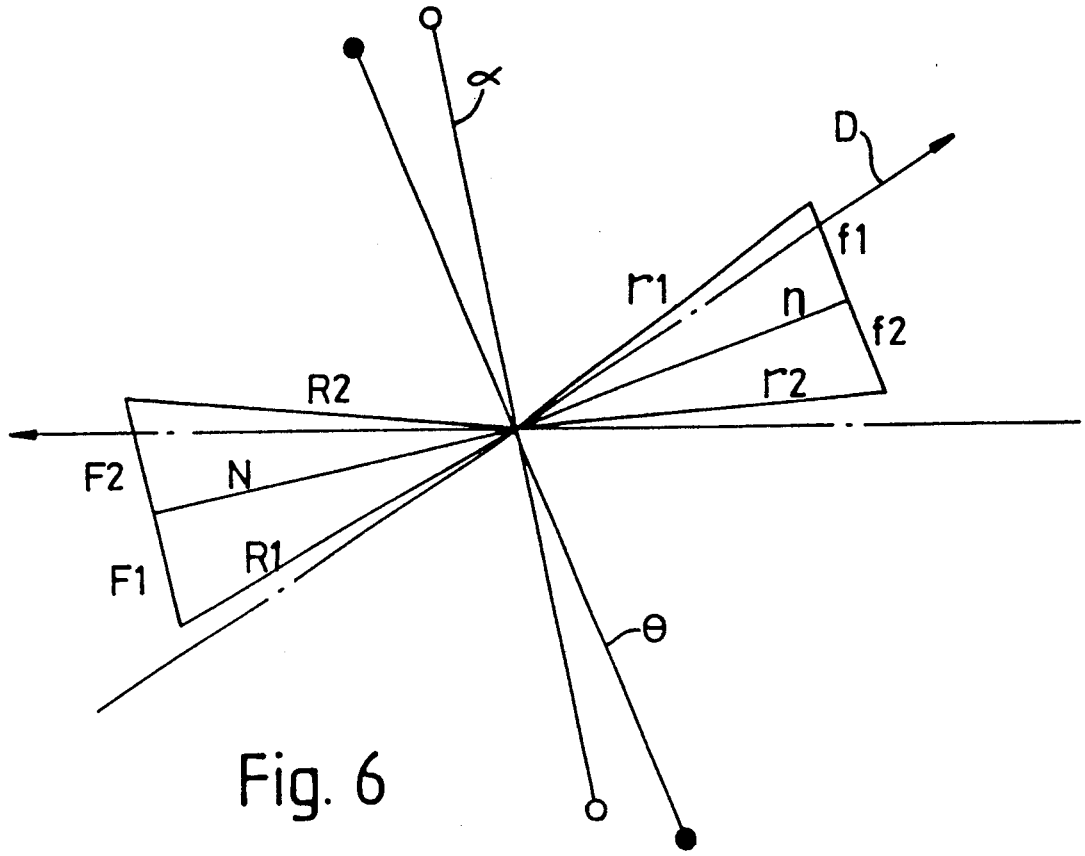
Figure 7:
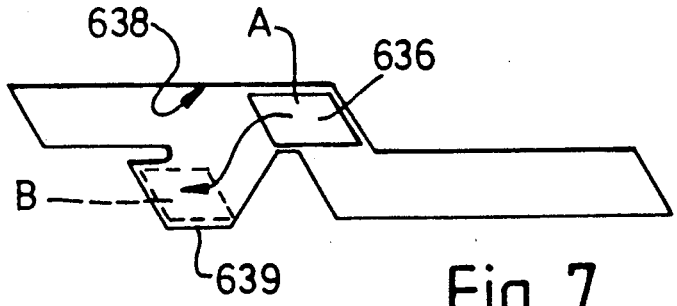
Figure 8:
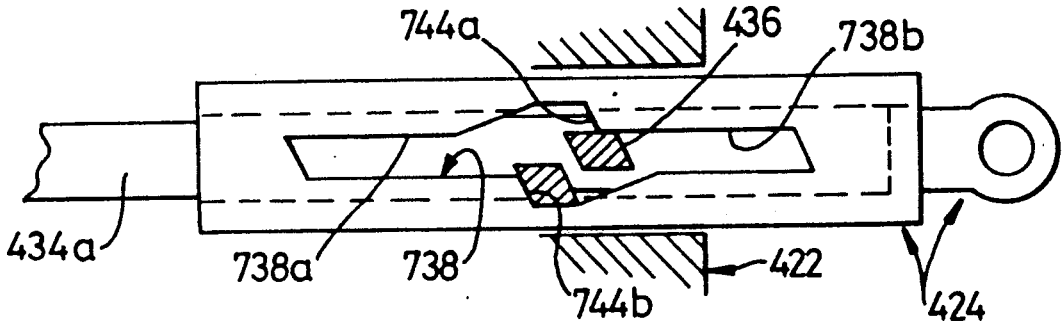

FIGS. 3*a–d* are diagrams of parts of the actuator of FIG. 2 at various respective stages of operation;

FIGS. 4*a–c* are diagrammatic representations of another form of servo-actuator being a second embodiment of the invention;

FIG. 5 is a diagrammatic perspective view of parts of a third embodiment of the invention;

FIG. 6 is a force vector diagram to assist in the understanding of the operation of the invention; and FIGS. 7 and 8 are diagrams of parts of respective modified forms of the actuators of FIGS. 2 to 4.

Figure 1:
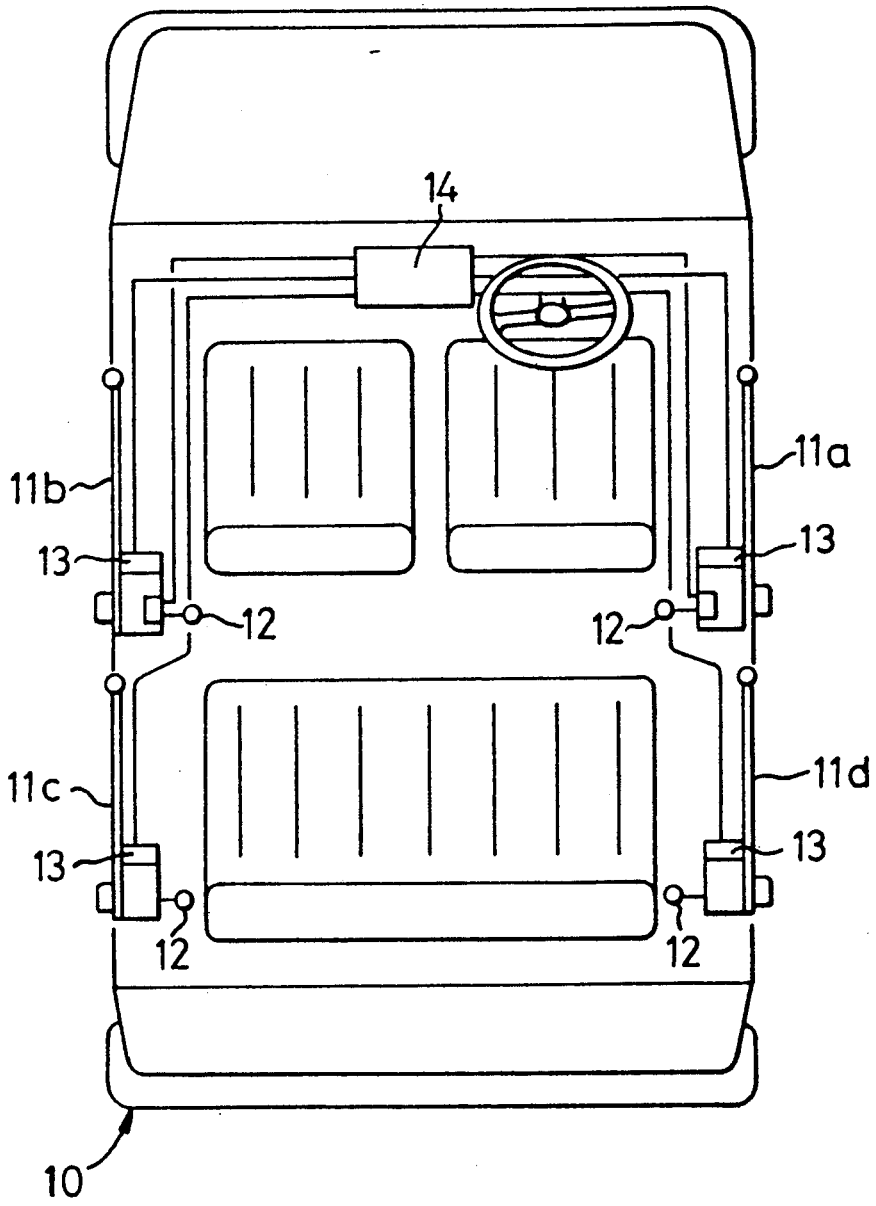
FIG. 1 is a diagram of a vehicle central locking system.

Referring to FIG. 1 a vehicle body shown diagrammatically at 10 has, in this example, four doors, front driver's and passenger doors 11*a*, 11*b* and two rear passenger doors 11*c* and 11*d*. Each door has a respective latch mechanism of known kind with associated lock mechanism, the latter including in the case of front doors 11*a*, 11*b*, provision for manual unlocking externally of the car by means of a key and, in respect of all the doors, manually operable internal release means, in this example respective sill buttons 12. Power actuating units 13 to be described in further detail below are mounted in association with each locking mechanism on each door and are electrically connected to a central control unit 14 of the locking system. Further locking mechanisms, e.g. of a tail-gate, boot-lid, bonnet etc may also be provided with power actuated units interconnected with the central control unit 14 but these have not been shown for clarity.

Referring next to FIGS. 2 and 3 a simple basic form of actuator embodying the invention is shown diagrammatically and, although it may have practical applications, is included mainly as a demonstration model for better understanding of the underlying principles of construction and operation.

The mechanism of this actuator includes a drive input slider 20 guided for rectilinear movement in fixed structure 22 of the actuator and selectively shifted in either direction by positively acting power means (not shown) e.g. an electric actuator motor.

A drive output slider 24 is also guided for rectilinear movement in structure 22 transversely at right angles across slider 20. For the purposes of illustration output slider 24 is shown coupled to a resilient loading shown as a tensioning spring 26 though, in practical use, slider 24 would be linked or coupled to the locking mechanism of a respective vehicle door latch through a spring, or the resilience could be provided by the inherent elasticity of the linkage or coupling.

Input slider 20 is formed with a diagonally extending slot 28 the spaced parallel edges of which form a pair of opposing ramp or camming faces 30,32 at an acute angle (e.g. about 20°–25° ) to the direction of movement of slider 20.

A drive transmitting clutch element is captive between the sliders and acts to transmit forces from one to the other. Said element comprises a rectangular block 34 located as a running fit in slot 28 so that its sides are acted on by the camming faces 30,32.

Said clutch element further includes a diamond shaped drive dog 36 fast with and protruding from the upper face of block 34 to project into and co-act with a cranked slot 38 in the output slider 24.

More specifically dog 36 is aligned so that one parallel pair of its side faces 40 extend along the direction of movement of output slider 24 and the slot 38 in the latter has opposite end portions whose parallel side faces 42 also extend in that direction, dog 36 being a running fit between them. The two end portions of slot 38 are offset laterally of slide 24 by a distance equal to their width to provide the cranked shape, spaced parallel inclined ramp or camming faces 44 corresponding in angle to inclined camming faces 46 being the other two parallel sides of dog 36. The two parts of the slot 38 are so arranged that dog 36 can pass from one to the other by lateral shifting with respect to slider 24 at the angle of faces 44,46 when it reaches the inner extremity of either end part.

Said faces 44,46 extend at a less acute angle with respect to the direction of movement of slider 24 than the angle of camming faces 30,32 with respect to the direction of movement of the input slider 20, e.g. of some 60°.

Referring to the sequence of operations illustrated in FIGS. 3*a–d*, FIG. 3*a* shows output slider 24 (right hand tip of slot 38 at datum x in FIG. 3) extended leftwards from structure 22 which would put the locking mechanism in an unlocked condition for free operation of the latch mechanism to open and close the associated door. Drive dog 36 is aligned with the right hand end portion of slot 38 thus slider 24 can shift freely to the left i.e. the associated individual lock mechanism can be operated manually as by a sill button 12 to lock the associated door without any obstruction from or operation of the actuator.

Powered downward movement of input slider 20 will apply a camming force between face 32 and the abutting side face of block 34 urging it to the left as viewed in the drawings so that face 46*b* of drive dog 36 is carried into abutment with camming face 44*b* to carry output slider 24 to the left against the load resistance via spring 26, i.e. in practice pulling the linkage to actuate the lock mechanism, the latter being shifted to a locked position.

The angles of the various camming faces are such that the force vectors applied during said powered shifting of the input slider 20 against the load reaction via the spring 26 (i.e. from or coupled to the locking linkage in practice) acting on output slider 24 urge dog 36 downwards as viewed in the drawings by a force exceeding the camming force between faces 44*b* and 46*b* which would tend to slide the dog upwardly, thus driving force is positively transmitted to operate the lock mechanism.

The actuator motor will stall when slider 24 reaches its limit of leftward retraction (datum y in FIG. 3) but as long as power continues to be applied to input slider 20 the balance of forces is maintained and dog 36 is retained in the position shown in FIG. 3*b*.

When driving force ceases to be applied to input slider 20 the balance of forces changes, the stressing of spring 26 (i.e. of the linkage to the locked mechanism) is tending to pull output slider to the right but there is no longer any substantial downward component of force acting on block 34, the direction of frictional engagement of the camming surfaces is reversed and different force vectors are applied thereto such that dog 36 is cammed upwardly (FIG. 3*c*) by face 44*b* to enter the upper and left hand end portion of the slot 38 at the same time removing the stressing of the linkage. Output slider 24 will shift slightly to the right (FIG. 3*c* and FIG. 2) to datum z of FIG. 3 which prevents downward displacement of dog 36, the latch remains locked but it can be unlocked (or re-locked) by operation of the manual means (e.g. the sill button) pulling slider 24 to the right to the extent permitted by left hand portion of slot 38.

If a second downward powered shifting of input slider 20 follows said first locking actuation without any intervening powered unlocking movement, dog 36 will be shifted to the left along the left hand portion of slot 38 until it abuts the end thereof (FIG. 3*d*) when the drive motor will stall once more. The linkage is stressed again (datum y) but this time dog 36 is contained by the blind end of slot 38 and cannot shift laterally however great the pull applied to the linkage due to the acute cam angle or faces 30,32 on the drive input slider 20. This puts the locking mechanism and hence the door latch into a deadlocked or superlocked condition, it is impossible to free the mechanism by the manual means such as the sill button or by pulling on the linkage due to the acute cam angle of faces 30,32 on slider 20. The superlocked condition can only be cancelled by powered shifting of the input slide 20 upwardly as viewed in the drawings, so camming block 34 to the right by its interaction with camming face 30 to shift dog 36 back through the FIG. 3*c* position. As this rightward shifting movement continues the then leading angled face 46*a* of dog 36 abuts the inclined camming face 34*a* to carry output slide 24 to the right to effect unlocking movement of the linkage. When it reaches its outward extremity (datum x) stalling takes place once more and, when the driving force ceases, the dog 36 will be cammed downwardly to the FIG. 3*a* position ready for the next powered or manual locking cycle.

Force vector diagrams are imposed on FIGS. 2,3*b* and 3*c* which can be related to the description below with reference to FIG. 6 for further understanding of the operation of the actuator as above. During locking drive dog camming face 46*b* engages the camming face 44*b* of the output slider 24 giving a force balance in which a drive vector D (FIG. 2) is transmitted between the camming face 32 of slide 20 and block 34. This vector D is outside the limiting friction triangle R1,F1,N of the low angle of these camming faces thus it overcomes friction and they slide in the required way. The forces are transmitted through the drive dog 36 and thence to the output slider 24 through the inclined high angle camming face 44*b* (FIG. 3*b*). Drive Vector D is outside the friction triangle f1,r1,n of said face so that the dog slides downwardly i.e. further into engagement as referred to above and these forces continue to apply while power is applied to slide 20 in the stalled condition referred to above.

When said drive force is removed the force vectors change and friction direction on the camming surfaces is reversed, the stressing of spring 26 (i.e. pull of stressed locking linkage) results in a release vector R acting on the camming faces (FIGS. 2 and 3*c*) vector R is within the friction triangle R2,F2,N of the input slider camming face 32 so that no sliding motion occurs there but it is outside the friction triangle f2,r2,n of the output slider camming face 44*b* so that sliding motion between it and dog 36 takes place shifting it until it passes out of engagement with said camming face. The stresses are then relieved and cause slight shifting of output slider 24 to the right as described above, even though no movement of block 34 with respect to slider 20 has taken place.

Reference is now made to FIGS. 4*a*,*b*, and *c* representing diagrammatically a screw-type actuator embodying the invention which can be provided in a particularly compact and convenient form. The same reference numerals prefixed by a 4 are used for parts having the same function as those described in reference to FIGS. 2 and 3.

In this construction a drive output slider 424 is guided for rectilinear but non-rotational movement in operatively fixed body structure 422 of the actuator unit, slider 424 being operatively linked to locking mechanism of the associated door latch as previously described. Slider 424 is conveniently a moulding of high tensile plastics material, the portion sliding within structure 422 being a hollow box section open at its inner end.

The opposing side walls of this section (one only visible in the drawings) each have a longitudinal slot 438. The opposite end portions 438*a*, 438*b* of the slot are offset laterally by a distance equal to their width to provide a cranked shape with oppositely directed camming faces 444*a* and 444*b* at a middle region of the slot as described in relation to FIG. 2.

The actuator further includes an electric motor 452 in positive drive connection through a speed reducing gear train 454 with a drive input element in the form of a wormscrew 420 journalled in structure 422 so that is rotatable but not axially displaceable.

A drive transmitting clutch element interconnects screw 420 and output slider 424 and comprises a nut 434 in threaded engagement with screw 420, the worm and nut having a low helix angle alpha i.e. the drive is unidirectional, it impossible for axial forces applied to nut 434 to overcome the friction of the thread so as to cause rotation of screw 420.

For clarity in the drawings the clutch element is shown as an elongated member with nut 434 at one end and a shaft 434*a* extending axially into the hollow interior of the output slider 424 though in practice a compact structure would be provided in which a nut of short axial length was located within the slider 424, the screw 420 extending axially within the slider; or the clutch element was located within the drive input element and nut. The end of shaft 434*a* as represented here carries a pair of opposed laterally projecting diamond shaped drive dogs 436 (one only shown) which are a running fit in the slots 438.

The screw 420 and the clutch element (nut 434 with dogs 436) are conveniently also mouldings of high duty plastics material.

Nut 434 is located for axial movement relative to structure 422 and can also rotate within the structure and relative to output slider 424 to a degree determined by the engagement of dogs 436 laterally within the slots 438. Nut 434 is a friction fit on screw 420 so that it is urged angularly in the same direction of rotation as the screw.

Angled camming front and rear faces 446*a*, 446*b* of the dogs co-act with the camming faces 444*a*,*b*, of slider 424. The action is the same as the drive dog described with reference to FIGS. 2 and 3 though, in this context, the dog may be regarded as a screw having a part-thread only with a high helix angle theta co-acting with a part-threaded nut (slider 424) having a corresponding helix angle (inclined camming faces 444).

It is also possible that the drive dogs 436 could be simple circular section pegs projecting laterally of the nut shaft 434*a*, the angled camming effect being provided solely by the faces 444. It is also to be understood that the arrangement could be reversed, the slot providing camming faces being provided on the nut or other drive transmitting clutch element to co-act with a drive dogs or dogs on the output slider 424 i.e. the latter could be a rod or shaft extending within a hollow nut or other clutch element.

A worm screw is a simple and inexpensive way of converting rotary forces into linear forces for servo actuation but the high friction of a normal low helix angle wormscrew and nut prevents manual override, i.e. displacement of the output member on manual actuation of the lock coupled thereto unless there is some provision for disconnecting the worm drive from the output member or linkage. With the construction shown the advantages of the worm drive are retained while still providing full flexibility of operation by manual or servo-actuation and with the added advantage of particularly simple and reliable deadlocking or superlocking.

This form of actuator operates on the same principles as that described with reference to FIGS. 2 and 3 though there are some differences of detail. Referring to FIG. 4*a* the output slider 424 is extended from body structure 422 i.e. the locking mechanism linked therewith is in an unlocked condition. The drive dogs 436 are aligned in the end portions 438*b* of slots 438, thus the output slider 424 is free to shift in either direction as the locking mechanism is manually operated, e.g. by its associated sill button 12.

The motors 452 of this and the like actuators on the other doors of the vehicle are connected electrically to the central control unit 14 which is activated from one or more master control points, e.g. the exterior key operated lock of the driver's door 11*a*. Assuming that central locking of all the doors by servo-actuation is required the control unit 14 will be activated to apply power to motors 452 to drive the associated wormscrew 420 in a direction for drawing nut 434 inwardly i.e. to the left as viewed in FIG. 4. The frictional engagement of the nut on the screw also applies torque to the former tending to rotate it in the same direction as screw 420. As dogs 436 are shifted to the left as viewed in the drawings they are biased angularly in the slots so that their rearward camming faces 446*b* engage the forwardly directed camming faces 444*b*. This engagement is maintained by the force vector exerted by the wormscrew 420 against the resistance from the tensioning of the lock mechanism and associated linkage. The slider 424 is retracted inwardly of body structure 422 to shift the lock mechanism to a locked condition, motor 452 stalling when the limit of travel is reached.

When power to motor 452 is switched off the resilient loading or stressing of the linkage tends to pull slider 424 outwardly of the body structure by a short distance and this is sufficient to change the friction forces and apply the release vector rather than the drive vector so that the abutting camming faces urge the dogs 436 to shift angularly into the other end portions 438*a* of the slots as illustrated in FIG. 4*b*. As said tensioning forces are dissipated the slider 424 shifts slightly so that the dogs 436 are positioned rearwardly of the camming faces 444*b* and will not re-engage them if screw 420 is again rotated in the locking direction.

If a further locking command is given through control unit 14 motor 452 will again rotate to drive worm 420 in the same direction as before and the dogs 436 will thus be drawn fully inwards until they stall the motor by reaching the innermost end of said slots as shown in FIG. 4*c*. The slider 424 and associated linkage is now locked solid, operation cannot be overridden manually and the latches of all the doors will be superlocked.

It will be noted that as superlocking is effected by two successive operations of the same power unit (motor 452) no extra wiring is required between the control unit and the actuators to provide this facility. The latches will be freed again for manual operation and/or unlocked by servo-actuation by applying reverse drive to motor 452 to rotate screw 420 and shift nut 434 with the associated dogs 436 from left to right as shown in the drawings. The dogs are now angularly biased in the opposite direction against the sides of the slots 438 so that their camming faces 446*a* engage camming faces 444*a* to drive slider 424 outward and effect unlocking.

FIG. 5 shows components of a further embodiment providing a rotary or angular output instead of rectilinear output.

Here the output member is a rotary crank 524 riding on a shaft 525 journalled in body structure 522, crank 524 can rotate freely but is constrained against axial displacement.

The crank includes a sleeve 527 having a through slot 528 shaped as in FIGS. 2 and 3 extending part way round its circumference i.e. sleeve 527 can be regarded as a cylindrical version of the flat output slider 24 of FIG. 2.

A drive transmitting clutch element 534 is generally cylindrical and is located on shaft 524 co-axially with sleeve 527, it is rotatable and also axially displaceable relative thereto.

Element 534 includes a stub shaft 534*a* extending within sleeve 527 and mounting a diamond shaped drive dog 536 having high angle camming faces which co-acts with slot 528 as described with reference to FIG. 2. The end of element 534 remote from dog 536 is in the form of a skew gear 531, the faces of its angled teeth constituting low angle camming faces.

Various forms of drive input members could co-act with skew gear 531, for example another meshing skew gear on a parallel or angled axis, in this particular embodiment the input member is a single start worm gear 520 selectively rotatable in either direction by an actuator motor (not shown) on an axis in a plane normal to the axis of shaft 525 and is resiliently loaded by a spring 521 determining the minimum contact friction between the two gears.

The underlying principles of operation of this arrangement are as previously described. Powered rotation of gear 520 is transmitted to rotate gear 531 and the associated drive dog 536 while, at the same time, the angling of the gear teeth urges the clutch element 534 axially along the shaft 525 so drawing the relevant camming face of dog 536 into driving engagement with a camming face of the slot 528 to shift the output crank in the appropriate direction for locking or unlocking. When power ceases to be applied the backward forces from tensioning of the linkage act on said camming faces to displace the clutch element 534 axially for disengagement. A second powered locking cycle will deadlock the actuator, an unlocking cycle will free it and shift the linkage to the unlocked position.

The drive and release vectors and associated friction triangles are superimposed on FIG. 5 as with the previous Figures and can be related to the following.

FIG. 6 is an enlarged and more detailed diagram of the force vector systems used in the invention and as indicated in the other drawings. The low camming face or helix angle alpha and high camming face or helix angle theta are here superimposed on a common centre. The driving force vector is indicated by arrow D and the release force vector by arrow R. The friction triangles bounded by R1, F1 and N (N is normal to the helix or face at angle alpha) is the low helix angle friction triangle when driving force D is applied. Triangle R2,F2, N is the triangle of the low helix angle relevant to release force R. Similarly triangle r1,f1, n is the drive force friction triangle of the high helix angle theta with triangle r2,f2, n being the equivalent triangle for that angle for the release force vector R. Forces within the relevant friction triangle will not overcome friction to permit movement between the associated helices or camming faces, those outside the relevant triangle will permit relevant movement thereof.

In FIG. 6 it is to be noted that the driving force vector is shown as being inside the friction triangle r, f, N unlike FIG. 2. This mode of operation may be less positive and secure but may be a satisfactory alternative for some practical applications.

A number of other mechanical characteristics can be embodied to aid the general operation, particularly to provide more compact construction and to aid reliable clutch operation.

With reference to FIG. 7 a modified form 638 of the slot 38 used in FIGS. 2, 3 and 4 for example, may be provided. For superlocking, instead of travelling the full length of the slot as in FIG. 2 or 3 for example, requiring further drive displacement and associated working space, a siding 639, in the form of a cranked blind ended arm can be provided in the slot 638 directed to one side and rearwardly from the rear end part of the slot. The drive dog 636 will not enter the siding 639 as a result of any manual action after the locking actuation and subsequent de-clutching, i.e. from the position A shown in full lines in the drawing. To superlock, a second actuation from position A will bias the dog against the side face of the rear end portion of the slot such that as it progresses to the left hand end of the slot as viewed in FIG. 7 it will enter siding 639. When the dog abuts the blind end of the siding at position B shown in broken lines, the actuator motor will stall. On de-energisation of the motor, the actuator will be superlocked as dog 636 cannot de-clutch from out of the siding.

To unlock the actuator the motor must be operated to drive the dog 636 to the right while being biased laterally for it to escape from the siding. On leaving the siding the dog will engage on the camming face as before to unlock the connecting latch.

The net result is an overall shortening of the assembly of components and reduction in their overall relative movement making up the lock/unlocking/superlocking displacement so allowing a more compact design and reduced operating clearances.

Another modified form of slot 738 is shown in FIG. 8. The actuator drive is as in FIG. 4 and the sequence of operations is the same, however, slot 738 has rectilinearly aligned inner and outer end portions 738*a*, 738*b* with laterally extending notches 739*a*, 739*b* at median portions of the slot sidewalls, each notch being shaped to provide oppositely directed angled camming faces 744*a*, 744*b* which co-act with angled faces of the dog 436 as previously described.

To aid disengagement of the clutch, elasticity can be built into the input drive system by effectively having the actuator motor connected to the gearing via a torsion spring or incorporating a spring effect into the drive components. This allows some internal wind-up during powered actuation, this helps the clutch disengagement in certain circumstances by back-driving the motor on de-energisation with the intention of building up its inertial momentum to make it overtravel thus driving (or helping to drive) the motor out of engagement.

This effect may enable less critical selection of and interaction by the cam angles with a more positive engage mode. The dampening effect also reduces shock-loading at the end of superlock travel to help prevent binding or lock-up.

I claim:

1. Vehicle door latch lock power actuating mechanism including an operatively power driven drive input element, a drive output element operatively connected for positive actuation of the lock between locked and unlocked conditions, and a clutch element operating to engage and transmit drive from the input to the output element but having a disengaged condition permitting actuation of the lock independently of said drive; characterised in that one of the input element and clutch element includes a first force transmitting camming formation with which a first coacting formation being included in the other of said elements coacts, and one of the clutch element and output element includes a second force transmitting camming formation with which a second coacting formation being included in the other of said latter elements coacts, said formations having acting faces so angled and disposed relative to each other that drive force translated from the input element through the first formations for movement of the output element against reaction loading on the latter element includes a component urging the second formations into continued positive drive transmitting engagement but reaction forces translated from the output element with no drive force from the input element will cam said second formations out of drive transmitting engagement with each other to put the mechanism into said disengaged condition.

2. Mechanism as in claim 1 characterised in that the input element includes the first camming formation, the clutch element includes the first coacting formation and the second camming formation, and the output element includes the second coacting formation.

3. Mechanism as in claim 2 characterised in that the output element is guided for rectilinear movement and in that the second coacting formation includes a rectilinear acting face angled with respect to the direction of said movement.

4. Mechanism as in claim 2 characterised in that the input element is guided for rectilinear movement and in that the first camming formation includes a rectilinear acting face angled with respect to the direction of the latter movement.

5. Mechanism as in claim 2 characterised in that the output element is guided for rotary movement and in that the second coacting formation includes a helical acting face angled with respect to the direction of said rotary movement.

6. Mechanism as in claim 2 characterised in that the input element is guided for rotary movement and in that the first camming formation includes a helical acting face angled with respect to the direction of said rotary movement.

7. Mechanism as in claim 6 characterised in that the input element is a screw and the clutch element includes a threaded nut engaged with said screw, the acting faces of the first formations being constituted by the interengaging threads of the screw and nut.

8. Mechanism as in claim 6 characterised in that the input element is helically toothed worm or skew gear and the clutch element is guided for rotary movement relative to both the input and output elements and axial displacement relative to the output element; and in that the clutch element includes a helically toothed gear meshed with the input element, the acting faces of the first formations being constituted by the meshing teeth of said gears.

9. Mechanism as in claim 6 characterised in that the input element is operatively driven by a rotary electric motor for providing the powered actuation of the lock.

10. Mechanism as in claim 1 characterised in that a first effective acting angle of the acting face in coaction between the first formations with respect to the direction of movement of the input element is substantially different from a second effective acting angle of the acting face in coaction between the second formations.

11. Mechanism as in claim 10 characterised in that the first angle is substantially less than the second angle.

12. Mechanism as claim 1 characterised in that in said disengaged condition the elements are so positioned that a successive movement of the input element in the locking direction effects superlocking by positive non-camming engagement between the second coacting formation and the second camming formation retaining the output elements in the locked condition.

13. Mechanism as claim 1 characterised in that the second camming formation includes a protruding drive dog and the second coacting formation is a slot in the output element within which said dog is relatively moveable.

14. Mechanism as in claim 13 characterised in that said slot is shaped to confine the dog against lateral displacement relative to the direction of movement of the output element except at a median portion of the slot, said portion being provided with camming faces.

15. Mechanism as in claim 14 characterised in that the slot has a cranked shape, having opposite end portions which are laterally offset with respect to each other.

16. Mechanism as in claim 14 characterised in that the slot has laterally aligned opposite end portions but a wider median portion providing angled acting faces.

17. Mechanism as in claim 13 characterised in that superlocking is effected by shifting the dog into abutment with an extremity of an end portion of the slot.

18. Mechanism as in claim 13 characterised in that said slot is shaped to provide a blind ended arm, the dog being biased into abutment with the extremity of said arm to effect superlocking.

* * * * *